United States Patent [19]

High et al.

[11] 4,167,344

[45] Sep. 11, 1979

[54] ELECTRONICALLY CONTROLLED TOKEN ENGRAVING APPARATUS

[75] Inventors: Cliff R. High, Tacoma; Karl D. Falaschi, Puyallup, both of Wash.

[73] Assignee: Morley Studios, Tacoma, Wash.

[21] Appl. No.: 812,279

[22] Filed: Jul. 1, 1977

[51] Int. Cl.[2] ..... B41J 3/40

[52] U.S. Cl. ..... 400/130; 400/134

[58] Field of Search ..... 197/6.4, 6.7; 101/4, 101/18, 11, 43, 44; 214/8.5 F; 221/264; 400/130, 131, 134

[56] References Cited

U.S. PATENT DOCUMENTS

| | | | |
|---|---|---|---|
| 1,494,839 | 5/1924 | Heene | 197/6.7 |
| 2,085,767 | 7/1937 | Reid | 214/8.5 F |
| 3,312,174 | 4/1967 | Cunningham | 197/133 R X |
| 3,360,093 | 12/1967 | McDonald et al. | 400/131 X |
| 3,630,334 | 12/1971 | Connolly et al. | 400/130 X |
| 3,861,299 | 1/1975 | Drillick | 400/130 X |
| 3,959,983 | 5/1976 | Dittrich et al. | 197/6.7 X |
| 3,960,257 | 6/1976 | High et al. | 197/6.7 |
| 4,031,993 | 6/1977 | Gurgens et al. | 197/6.6 |

*Primary Examiner*—Paul T. Sewell

*Attorney, Agent, or Firm*—David L. Garrison

[57] ABSTRACT

An electronically controlled token engraving apparatus, wherein a slide moves blank tokens from a blank token receiving station to an engraving station and, after engraving, to an ejection station, under the control of a digital logic system is disclosed. The slide includes a token receiving aperture that receives a blank token at the blank token receiving station. At the engraving station, a typehead comprising a plurality of radial type bars is manually rotated by an operator until the desired character type is located above the upper peripheral edge of the token. Thereafter, actuation of a switch causes a toggle press to press the end of the type bar and, thus, the type downwardly against the token causing a character to be engraved therein. Just prior to a character being engraved, the token is indexed a predetermined distance. After a character is engraved, the typehead is manually rotated until the next desired character type is located above the upper peripheral edge of the token. Thereafter the toggle press is again activated, the token is indexed, and a second character is engraved. This sequence is repeated until all of the desired characters, up to a maximum number, are engraved around the upper peripheral edge of the token. Subsequent to the last character being engraved, a further switch is actuated to cause the slide to move the engraved token to the ejection station.

38 Claims, 6 Drawing Figures

Fig. 4.
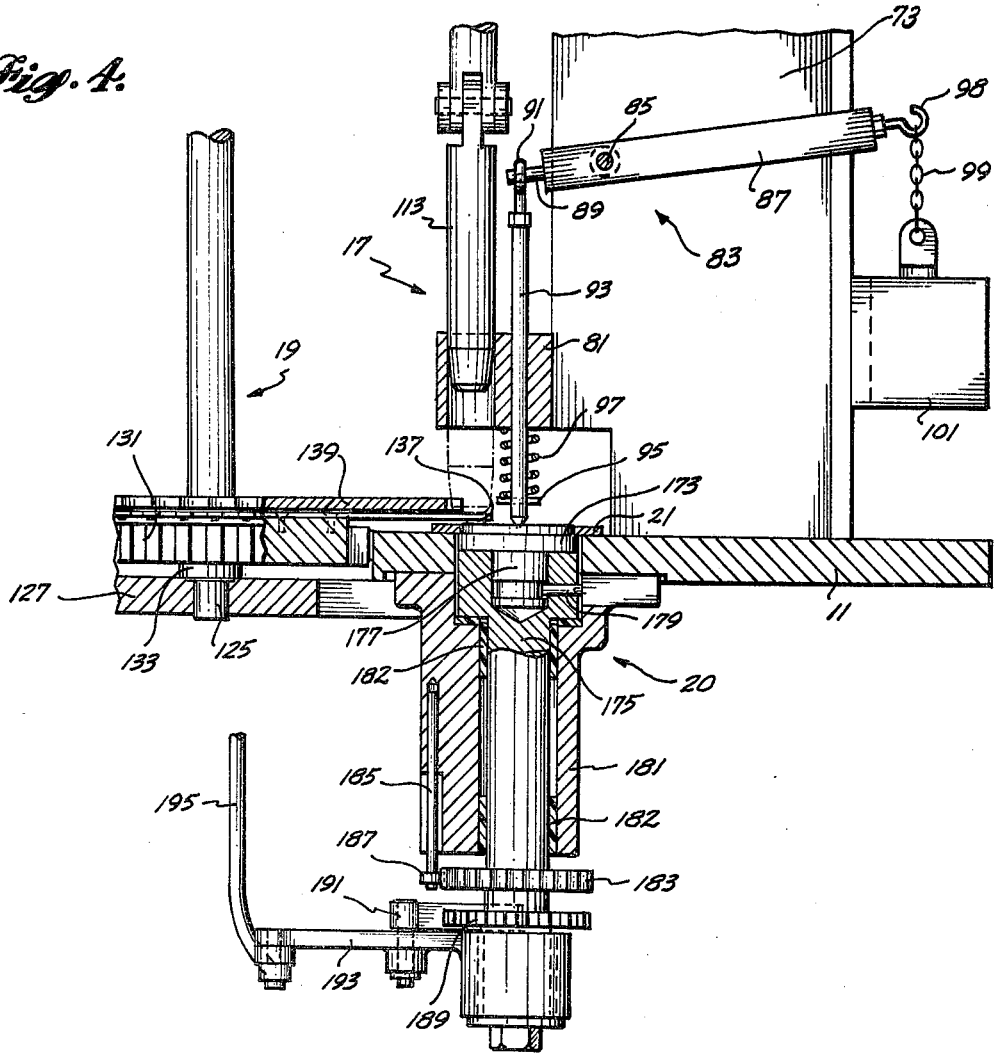
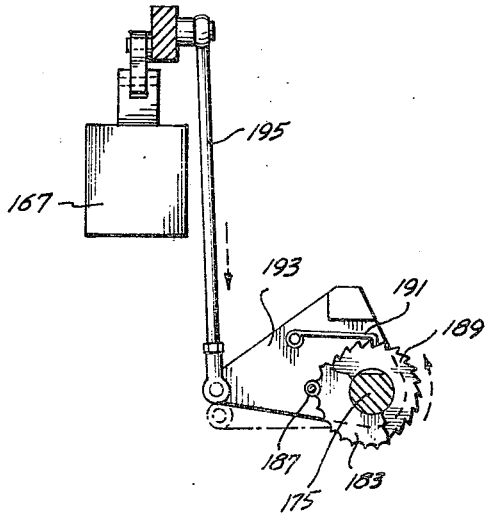
Fig. 5.

ELECTRONICALLY CONTROLLED TOKEN ENGRAVING APPARATUS

BACKGROUND OF THE INVENTION

This invention is directed to token engraving apparatus and, more particularly, to token engraving apparatus suitable for engraving selected characters onto one surface of a blank token.

As used herein, the term engraving is generic to the creation of characters in tokens by either depressing the character into the token or by depressing the material surrounding the characters so as to effectively "raise" the character. The latter technique is sometimes referred to as embossing. Thus, as will be better understood from the following description of the invention, while the mechanism of the invention preferably creates depressed characters because the pressure to be applied is less than that needed to create raised characters (and the image is usually clearer), it is to be understood that the mechanism can also be used to create raised (embossed) characters, if desired.

Various types of token engraving apparatus suitable for engraving characters into tokens have been proposed, and some are in use. For a variety of reasons, many of the older token engraving apparatus have not proven to be entirely satisfactory. Moreover, while recent advances have improved token engraving apparatus, the improved mechanisms have still not been entirely satisfactory. For example, while the invention described in U.S. Pat. No. 3,960,257 entitled "Apparatus for Conveying and Engraving Tokens" by Cliff R. High and Morley Brotman was a substantial improvement over earlier prior art devices, the apparatus described in that patent is still not entirely satisfactory. For example, the apparatus described in U.S. Pat. No. 3,960,257 is still substantially more mechanical than desirable. More specifically, the apparatus described in this patent depends upon the rather precise adjustment of cams and cam followers, plus other mechanical components, in order to reliably obtain clearly engraved tokens. Because of wear and other factors that affect mechanical mechanisms, the various components of this mechanism become misaligned after a period of time. As a result, clarity of engraving deteriorates. Also, the mechanical mechanism used to move tokens along a path of travel between a blank token receiving station, an engraving station, and an ejection station is more complex than desirable. Hence, while this prior art apparatus is an improvement over earlier apparatus, it is more complex than desirable and, thus, more expensive to produce and maintain. Moreover, it is less reliable than desirable.

Therefore, it is an object of this invention to provide a new and improved token engraving apparatus.

It is a further object of this invention to provide an uncomplicated mechanical mechanism for use in a token engraving apparatus.

It is another object of this invention to provide an electronic control system for controlling a token engraving apparatus, which reduces the mechanical complexity of the apparatus without eliminating any of its functions.

It is a more comprehensive object of this invention to provide an electronically controlled token engraving apparatus that has minimum mechanical complexity.

It is a still further object of this invention to provide an electronically controlled token engraving apparatus that is precisely controlled by an electronic subsystem such that clearly engraved tokens are reliably produced.

SUMMARY OF THE INVENTION

In accordance with certain aspects of this invention, a token engraving apparatus including a slide having a single token receiving aperture formed therein is moved between a receiving station, an engraving station and an ejection station. Blank tokens are held in a vertical stack at the receiving station. When the aperture in the slide is moved to the receiving station, the bottom token in the stack drops into the aperture. When the aperture is located at the engraving station, the token is located beneath one region of the outer periphery of a typehead formed of a plurality of radially extending arms. Each arm has a character type located at the bottom of its outer end. A press is located above the engraving station and, when actuated, is adapted to press the end of a type bar located above the outer peripheral edge of the token into the upper outer peripheral edge of the token. In this manner characters are engraved in the upper outer periphery of a token. The typehead is manually movable and a mechanism is provided for locking the typehead in place during the period of time that a particular character type is being pressed into the upper surface of the token. In addition, a holddown mechanism is provided for pressing the token against an anvil located at the engraving station, during engraving. Further, a mechanism is provided for indexing the token just prior to each engraving step.

In accordance with further aspects of this invention, an electronic control subsystem controls the operation of the mechanical mechanism of the token engraving apparatus. Preferably, the mechanism is coin operated. The insertion of a coin or coins into the machine by a customer actuates a first switch that enables the engraving of characters. Thereafter, the customer manually moves the typehead to a desired character position and, then, actuates a type switch. Actuation of the type switch first causes the token to be indexed and, then, the press to operate. Preferably, the typehead is locked in place during the engraving step. After a first character is engraved, the customer moves the typehead to the next character position and the type switch is again actuated. This sequence continues until all of the desired characters are engraved, or a maximum number of characters have been engraved. When engraving is complete, the customer actuates an eject switch. The eject switch causes the slide mechanism to move the engraved token to the ejection station where it is ejected. The slide then moves to the receiving station where it receives another blank coin. The slide continues to move until the new blank coin is positioned at the engraving station. At this point, the apparatus is deactivated and remains so until another customer inserts a coin or coins into the machine, and the engraving mechanism is again enabled. As an alternative to the customer actuating an ejection switch, the ejection sequence occurs automatically when a predetermined maximum number of characters have been engraved.

In accordance with further aspects of this invention, a display mechanism is provided. The display mechanism includes a counter that counts up by one each time a character is engraved, whereby a display of the number of characters that have been engraved is continuously provided to the customer. Further, a timer is started at predetermined times in the operational cycle. If certain actions are not complete before the timer times out, related mechanical mechanisms are assumed to be jammed; and, the timer causes an out of service indication and machine shutdown. Preferably the electronic control subsystem of the invention is formed of a plurality of digital logic circuits operable in sequence to control the mechanical mechanism of the invention. In this regard position sensors sense when the press and the slide are in idle or park positions. When a particular action is to take place, a related motor is activated. The motor causes the mechanism to go through a single cycle, which terminates when the mechanism returns to its idle or park position.

In addition to controlling the engraving functions of the invention, the electronic control subsystem also controls a chain dispenser adapted to dispense a chain useful with an engraved token to form a keychain. Further, the control subsystem senses the absence of blank tokens and causes machine shutdown and an out of service indication when the machine runs out of blank tokens.

It will be appreciated from the foregoing summary that the invention overcomes many of the disadvantages of prior art mechanisms, including the disadvantages of the invention described in U.S. Pat. No. 3,960,257, referenced above. Specifically, the invention provides an uncomplicated, mechanical mechanism suitable for use in a token engraving apparatus. The invention also provides an electronic subsystem adapted to perform many of the mechanical functions of prior art token engraving apparatus. As will be readily understood by those skilled in the art, electronic systems are substantially more reliable than cam and cam follower systems, and the like. Further, electronic control subsystems normally operate over extended periods of time without requiring servicing or readjustment, particularily when compared to mechanical control subsystems. Hence, the invention provides a more reliable and less mechanically complex token engraving apparatus when compared to prior art apparatus. Because it is less mechanically complex, it is less expensive with respect both to initial cost and maintenance.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings, wherein:

FIG. 4 is a partial, side elevational view, partially in section, of the mechanical mechanism illustrated in FIG. 1;

FIG. 5 is a detail view of the portion of the mechanism illustrated in FIG. 1 that indexes a token during engraving; and, FIG. 6 is a schematic, logic diagram of an electronic control subsystem of a token engraving apparatus formed in accordance with the invention and suitable for controlling the mechanical mechanism illustrated in FIGS. 1-5.

DESCRIPTION OF THE PREFERRED EMBODIMENT

Figure 6:
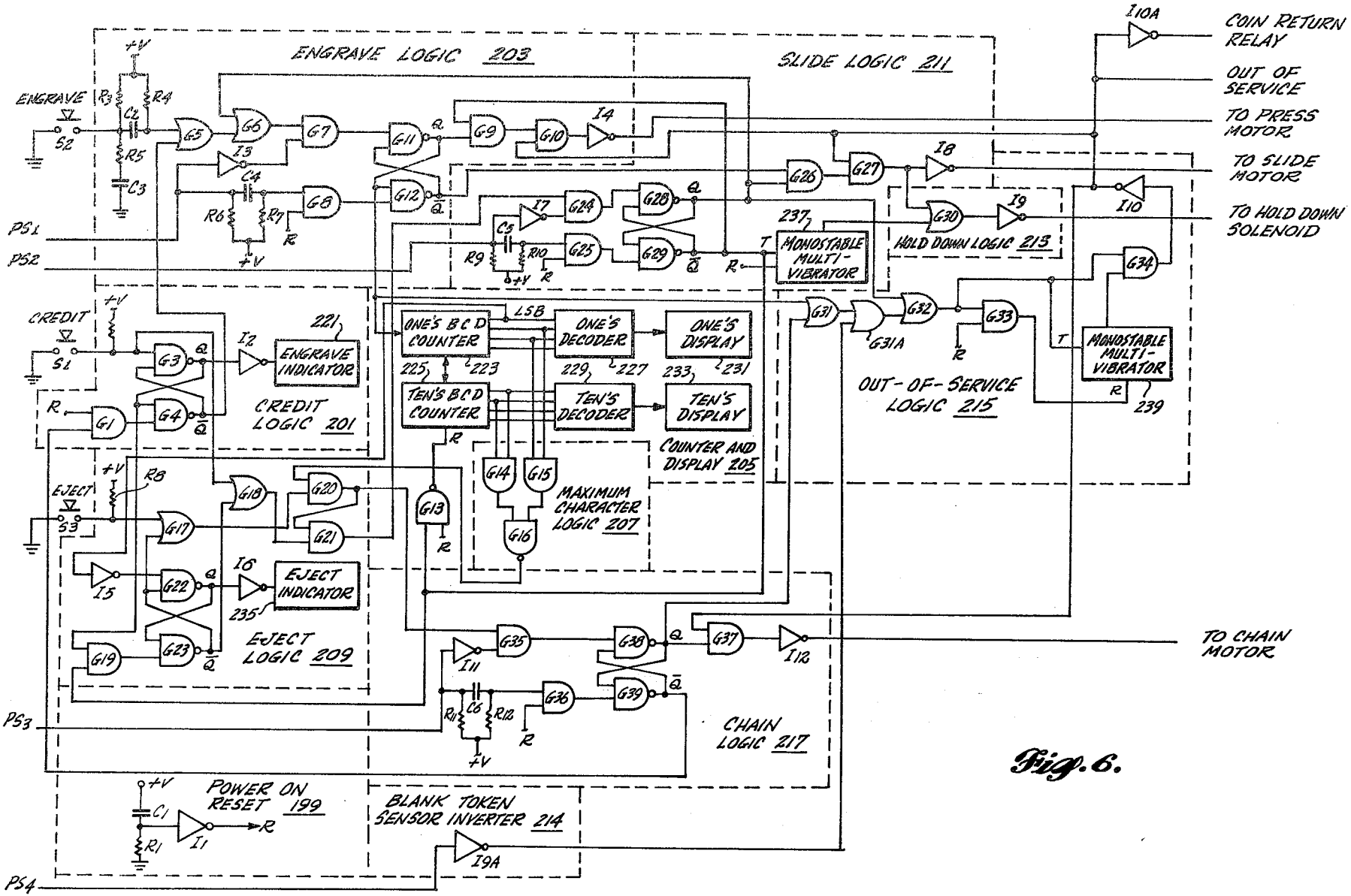

As will be better understood from the following description, this invention is directed to an electronically controlled token engraving apparatus. As such, the invention includes two main subsystems, a mechanical mechanism and an electronic control subsystem. The mechanical mechanism is illustrated in FIGS. 1-5; and the electronic control subsystem is illustrated in FIG. 6.

The mechanical mechanism illustrated in FIGS. 1-5 generally comprises: a support plate 11; a slide assembly 13; a token supply assembly 15; a press assembly 17; a typehead assembly 19; and, a token indexing assembly 20. The support plate 11 is mounted in a horizontal plane by a suitable supporting frame, shown in phantom in FIG. 1.

SLIDE ASSEMBLY

Figure 1:
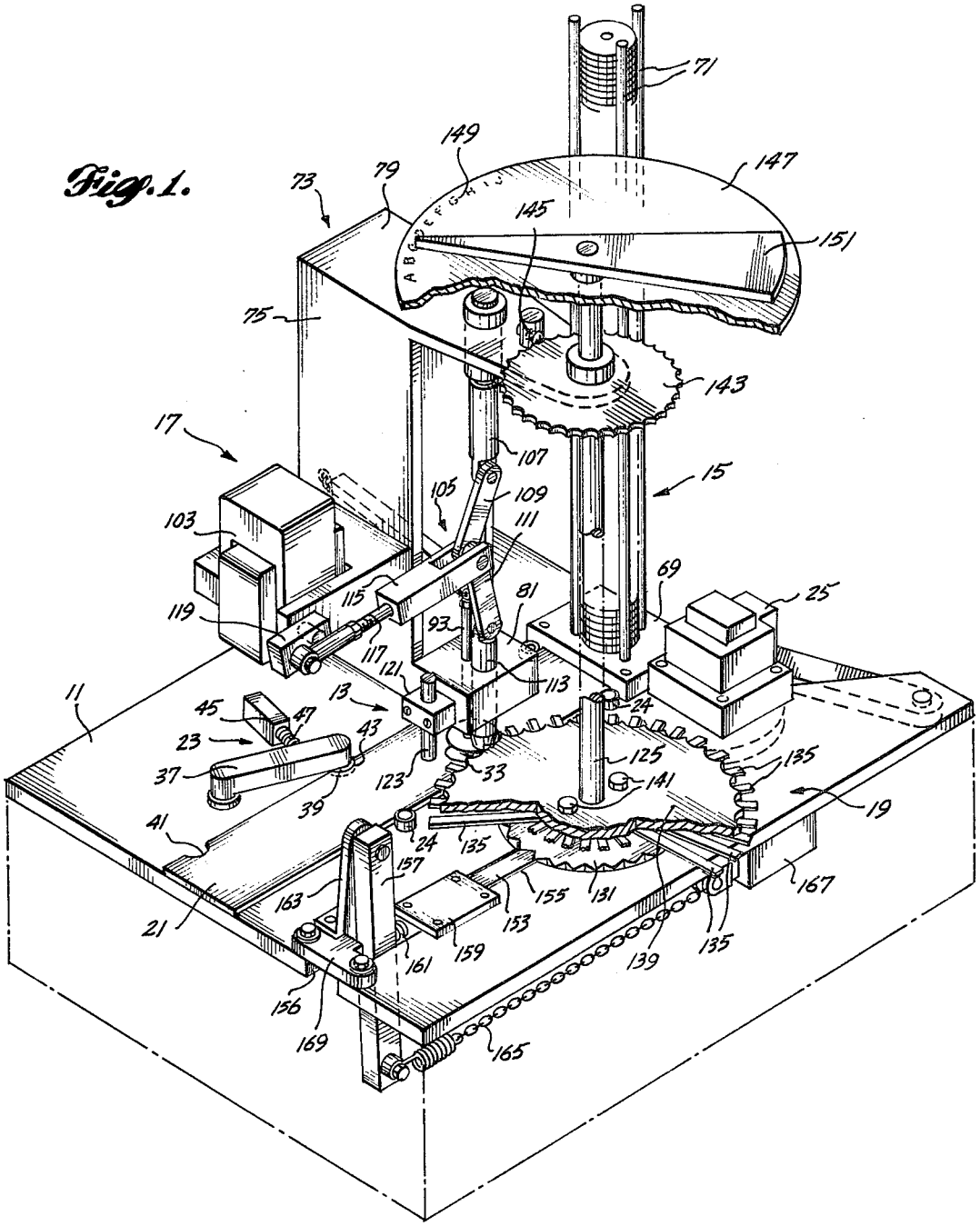
FIG. 1 is a top isometric view, partially in section, of a preferred embodiment of the mechanical mechanism of a token engraving apparatus formed in accordance with the invention.

The slide assembly 13 includes: an elongate, flat slide 21; a detent mechanism 23; a slide motor 25; a crank disc 27; a lever arm 29; and, a connecting link 31. The slide 21 lies atop the support plate 11, as best illustrated in FIG. 1. The slide 21 includes a token aperture 33, positioned along the length of the slide such that as the slide is moved back and forth in the manner hereinafter described, the token aperture is moved between a token receiving station located beneath the token supply assembly 15, an engraving station located beneath the press assembly 17 and an ejection station located between the token supply assembly and the press assembly. As will be better understood from the following discussion, the token supply assembly is located above the slide generally near one edge of the support plate 11. The press assembly is located inwardly, with respect to the token supply assembly edge of the support plate, along the path of travel of the slide 21. The detent mechanism 23 is located on the side of the press assembly remote from the side on which the token supply assembly is located, also along the path of travel of the slide 21. Lateral slide movement is prevented by a series of rollers 24 located along the longitudinal edges of the slide 21.

The detent mechanism 23 includes an arm 37 having one end rotatably attached to the support plate 11. The axis of rotation of the arm is vertical; and, the arm 37 points generally down the slide toward the token supply assembly 15. The outer end of the arm includes a roller 39 adapted to be swung into one or the other of two notches 41 and 43 located along the adjacent edge of the slide 21. Located on the side of the arm 37 remote from the slide 21 is a bracket 45. Located between the bracket 45 and the arm 37 is a coil spring 47. The coil spring is mounted such that it applies spring pressure against the arm 37 forcing the free or outer end of the arm toward the slide 21. Thus, when one or the other of the notches 41 or 43 is located adjacent to the roller 39, the roller is swung into that notch. When a suitable longitudinal slide movement force is applied, the roller moves out of the notch and the spring 47 compresses. As a result, the detect mechanism creates a force that tends to hold the slide against longitudinal movement at one or the other of its positions. However, the force created by the spring 47 is inadequate to prevent longitudinal movement of the slide when the slide movement mechanism applies a force to the slide in the manner hereinafter described. The notches 41 and 43 are located such that the token aperture 33 is located at the engraving station when the roller is located in one notch 43 and at the token supply station when the roller 39 is in the other notch 41.

Figure 2:
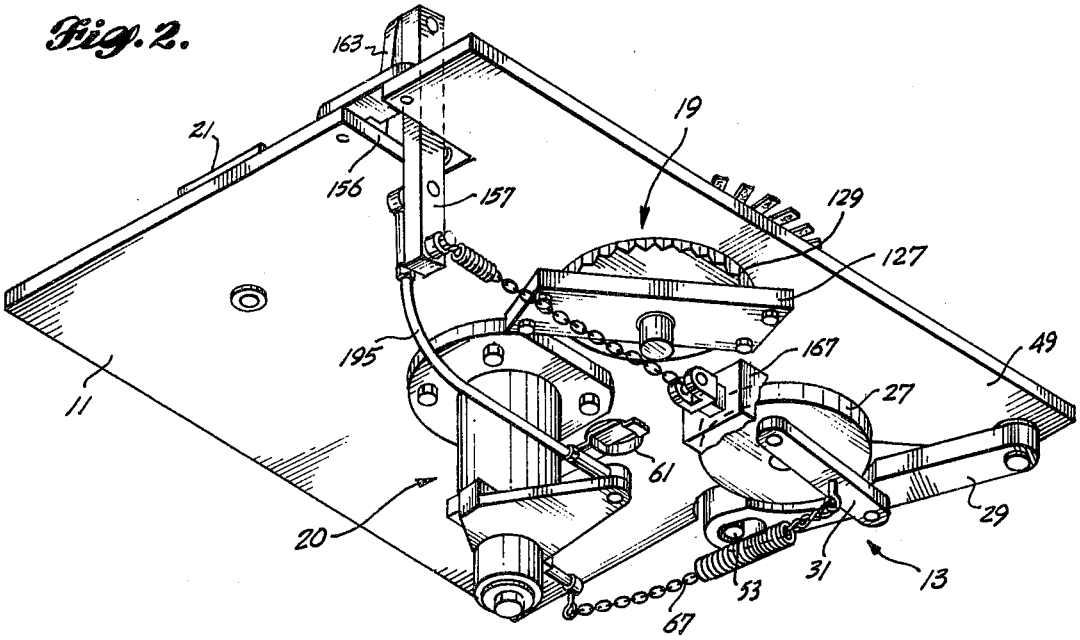
FIG. 2 is a bottom isometric view of the mechanical mechanism illustrated in FIG. 1.

The slide movement mechanism includes the slide motor 25, the crank disc 27, the lever arm 29 and the connecting link 31. The slide motor 25 is mounted atop the support plate 11 adjacent to the token supply assembly 15 on the side of the slide opposite to the press assembly 17. The motor is oriented such that its shaft rotates about a vertical axis. The shaft passes through the support plate 11; and, the crank disc 27 is mounted on the shaft of the slide motor 25, beneath the support plate, as best seen in FIG. 2. One end of the lever arm 29 is pinned for horizontal movement. The lever arm is pinned at a point located beneath an integral projection 49 projecting outwardly in the plane of, and forming part of, the support plate 11. The other end of the lever arm 29 includes an elongated slot 51. The longitudinal axis of the slot is coincident with the longitudinal axis of the lever arm 29. A pin 53 attached to, and projecting downwardly from, the adjacent outer end of the slide 21 lies in the slot 51. The connecting link 31 is vertically pinned at one end to the crank disc 27 and at the other end to the mid-region of the lever arm 29. The connecting link 31 is pinned to the crank disc 27 near the outer periphery of the disc.

Figure 3:
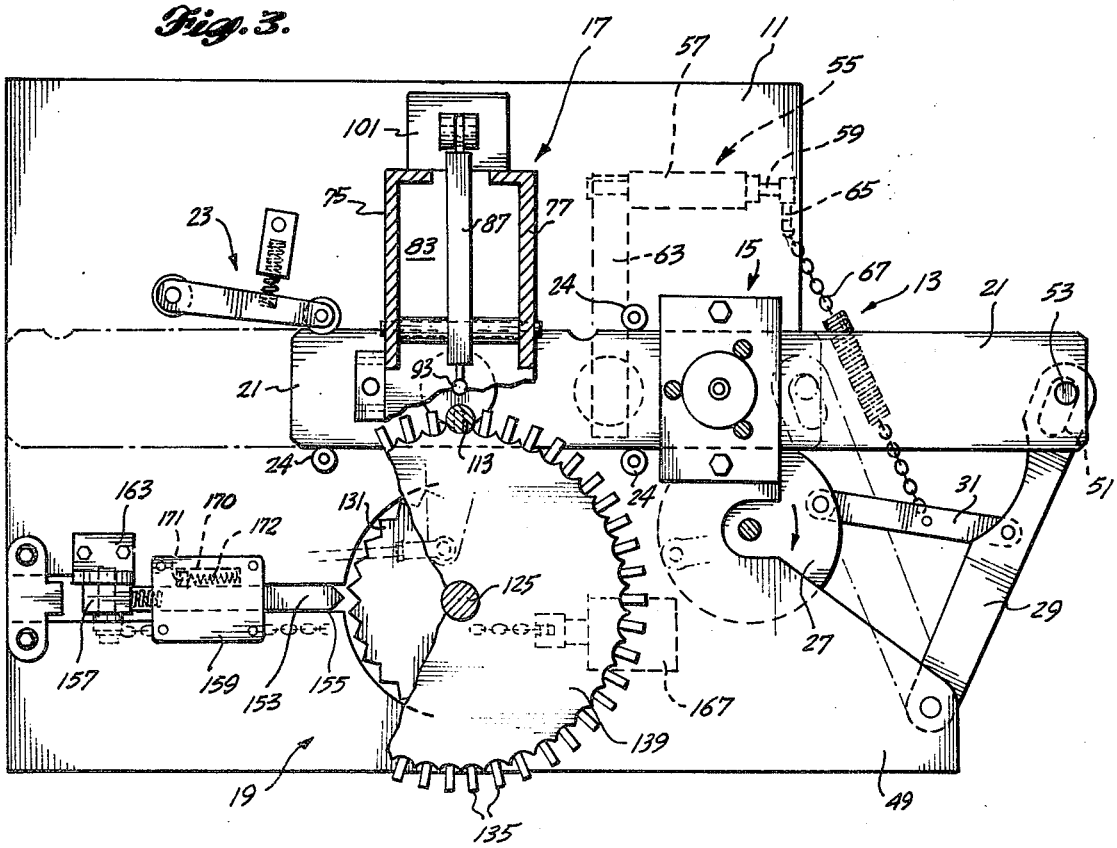
FIG. 3 is a top plan view, partially broken away, of the mechanical mechanism illustrated in FIG. 1.

When the slide is located such that the token aperture 33 is located adjacent the press assembly 17, i.e., at the engraving station, the connecting link 31 lies across the crank disc 27, as illustrated by the dashed lines in FIG. 3. When the slide motor is energized, as hereinafter described, the crank disc is moved through a single revolution. The direction of crank rotation is clockwise, when viewed from above. As a result of the coupling arrangement, when the crank disc 27 is rotated by the motor, the connecting link first pushes the lever arm outwardly, whereby the slide is moved outwardly (toward the right as viewed in FIG. 3). This action moves the token aperture from the engraving station to the token supply station. When the token aperture is at the token supply station, the detent mechanism 23 temporarily locks the slide; and, a blank token drops into the token aperture 33. As the crank continues to revolve, the connecting link pulls the lever arm inwardly, whereby the slide is moved inwardly (toward the left as viewed in FIG. 3). Inward movement continues until the token aperture and, thus, the blank token, is at the engraving station.

It should be noted that the detent and the slot/pin mechanisms eliminate the need for precisely forming the slide movement mechanism because they compensate for any slight misalignment of the components.

Also connected to the slide movement mechanism is a token ejection control mechanism 55. The token ejection control mechanism includes a bracket 57 mounted beneath the support plate 11. The bracket includes a central longitudinal aperture that houses a shaft 59. The shaft 59 lies along an axis lying generally parallel to the longitudinal axis of the slide 21. Affixed to one end of the shaft 59 and extending outwardly so as to lie beneath an ejection aperture 61 formed in the support plate 11 is an ejection arm 63. More specifically, one end of the ejection arm 63 is affixed to one end of the shaft 59. The other end of the ejection arm 63 includes a raised region that lies in the ejection aperture 61 when the shaft 59 is rotated clockwise (when viewed from its outer end).

A lever arm 65 is affixed to and projects downwardly from the other end of the shaft 59. The lower end of the lever arm 65 is connected to the mid-region of the connecting link 31 by a chain-coil spring connecting link 67. This connecting link is taut when the slide is moving a blank token from the token supply station to the engraving station. Thus, the raised region of the ejection arm 63 in the ejection aperture 61 during such movement. On the other hand, the chain-coil spring connecting link goes slack when the slide is moving an engraved token from the engraving station toward the token supply station. As a result, during such movement an engraved token is free to drop through the ejection aperture into a suitable receiving mechanism, such as a slide (not shown). In this manner, a single reciprocating slide moves blank tokens from the token supply station to the engraving station, without the tokens dropping through the ejection aperture and, thereafter, moves engraved tokens to the ejection station when they are ejected.

Token Supply Assembly

The token supply assembly, which is located at the token supply station, comprises an apertured plate 69 mounted above the slide 21. Projecting upwardly from the apertured plate 69, surrounding the aperture therein, are a plurality of cylindrical shafts 71. The cylindrical shafts 71 are positioned such that a vertical stack of blank tokens can be held above, and in line with, the aperture in the apertured plate 69. Due to gravity, the lower tokens in the stack will drop into an empty token aperture in the slide, each time the slide moves the token aperture to a point where it is aligned with the aperture in the apertured plate 69. Such alignment occurs when the slide 21 moves the token aperture 33 to the token supply station. Alignment is assured by the roller 39 of the detent mechanism 23 being swung into the related notch 41 in the slide 21.

Press Assembly

The press assembly 17 includes a vertically oriented housing 73 affixed to the support plate. The housing 73 extends upwardly from the support plate 11, on the same side of the slide 21 as the detent mechanism 23. The housing 73 is located between the detent mechanism 23 and the token supply assembly 15. The housing 73 includes a pair of vertical sidewalls 75 and 77 and a top wall 79 that extends outwardly so as to overlie the slide 21. The sidewalls 75 and 77 lie in planes orthogonal to the slide 21. In addition, a block-like bracket 81 supported by, or integrally formed with, the sidewalls 75 and 77 projects outwardly from the housing 73 so as to overlie the slide 21, below the slide overlying portion of the top wall 79. The bracket 81 is located slightly above the slide, as best illustrated in FIG. 4.

Also as best illustrated in FIG. 4, the press assembly 17 includes a hold down mechanism 83. The hold down mechanism 83 includes a shaft 85 extending between the sidewalls 75 and 77 of the housing 73. The shaft 85 lies above the block-like bracket 81 and is located near the edge of the sidewalls 75 and 77 nearest to the slide 21. Rotatably mounted on the shaft 85, for movement in a vertical plane, is an arm 87. The inner end of the arm 87 overlies the bracket 81; and, includes a pin-shaped tip 89. The pin-shaped tip 89 lies in an eye 81 attached to the upper end of a vertical hold down shaft 93. The vertical hold down shaft 93 passes through a suitable aperture in the block-like bracket 81; and, includes a collar 95 affixed to its lower end. Located between the collar 95 and the block-like bracket 81 is a coil spring 97. The block-like bracket supports the shaft 93 such that it overlies the center of a token when a token is located at the engraving station. The other end of the arm 87 includes a hook-shaped tip 98. The hook-shaped tip is connected via a chain 99 to a hold down solenoid 101 affixed to the housing 17.

In operation, the hold down solenoid 101 is de-energized when a token is at the engraving station. When the hold down solenoid is de-energized, the coil spring 97 presses the hold down shaft 93 downwardly against the top of a token. When the slide is to move, the hold down solenoid 101 is first energized, whereby the chain 99 is pulled downwardly. As a result, the arm 87 is rotated about the shaft 85 and the hold down shaft 93 is raised, against the force of the coil spring 97. Thereafter, the slide is moved in the manner heretofore described.

The press assembly 17 also includes a press motor 103 mounted on the wall 75 of the housing 73 facing the detent mechanism 23. The press motor 103 is mounted such that its shaft is horizontal. The press motor 103 operates a toggle press 105. The toggle press 105 includes an adjustable rod 107 affixed to, and projecting downwardly from, the portion of the top wall 79 of the housing 73 that overlies the slide 21. A flange, formed in the lower end of the rod 107, is rotatably connected to one end of a first connecting link 109. The axis of rotation is horizontal. The other end of the first connecting link 109 is rotatably connected to one end of a second connecting link 111. The axis of rotation of this connection is also horizontal. The other end of the second connecting link 111 is rotatably connected (also about a horizontal axis) to the upper end of a press head 113 mounted in a vertical aperture in the block-like bracket 81 affixed to the housing 73. The press head 113 is mounted in the bracket so as to lie above the outer, upper periphery of a token held at the engraving station by the slide. The lower end of the press head 113 converges inwardly in a downward direction, in the form of a truncated cone.

The joint between the first and second links 109 and 111 is connected to a horizontally arrayed yoke 115. The other end of the yoke 115 is connected, by an adjustable length connecting rod 117, to one end of a crank arm 119. The other end of the crank arm is affixed to the shaft of the press motor 103. The connection between the connecting rod 117 and the crank arm is rotatable, about a horizontal axis.

In the rest position, the shaft of the press motor is positioned such that the crank arm 119 points away from the housing 73. In this position, the connecting rod 117 and the yoke 115 pull the first and second links into a toggle position whereat they point in the direction of the press motor 103. As a result, the press head 113 is in a raised position. When the press motor is energized, its shaft goes through a single revolution cycle. As the motor shaft revolves, the crank arm 119 causes the connecting rod 117 and the yoke 115 to move the first and second links from the bent or toggle position to a straight line, vertical position and then back to a toggle position. This action causes the press head 113 to reciprocate downwardly and then upwardly. As will be better understood from the following description, this reciprocating movement causes the press head to press a character type into the upper surface of a blank token, at a predetermined point located along the outer peripheral edge thereof, whereby a character is formed in the token.

In addition to the foregoing structure, the press assembly also includes a slide hold down. The slide hold down comprises an arm 121 affixed to the block-like bracket 81 on the side thereof facing the detent mechanism 23. Projecting vertically downwardly from the block 121 is a rod 123. The lower end of the rod 123 is positioned slightly above the slide 21 whereby it prevents the slide from raising upwardly as it is reciprocated back and forth. As previously discussed lateral movement of the slide is prevented by a series of rollers 24 affixed to the support plate 11, on opposing sides of the slide 21.

Typehead Assembly

The typehead assembly 19 includes a vertically oriented typehead shaft 125. The vertical shaft 125 passes through a relatively large circular aperture 129 formed in the support plate 11. The relatively large aperture is located on the opposite side of the slide 21 from the press assembly, generally in line with the press head 113. The lower end of the typehead shaft is rotatably mounted in a bracket 127 that diametrically spans the relatively large circular aperture 129. The bracket 127 is affixed to and mounted beneath the support plate 11, as best seen in FIG. 2.

The typehead shaft 125 is also rotatably mounted in the outer end of the portion of the upper wall 79 of the housing 73 that extends outwardly and supports the adjustable rod 107 of the toggle press. Affixed to the vertical shaft 125 so as to lie in the relatively large aperture 129 is a cylindrical, typehead latch disc 131. The outer periphery of the typehead latch disc 131 is triangularly toothed. The thickness of the typehead latch disc is such that its upper surface lies slightly above the upper surface of the support plate 11, as best illustrated in FIG. 4. Preferably, a suitable washer or bushing 133 is located between the upper surface of the bracket 127 and the lower surface of the typehead latch disc 131. Affixed to the upper surface of the typehead latch disc 131 are a plurality of radially extending type bars 135, preferably formed of spring steel. The number of type bars is at least equal to the number of characters available for engraving, e.g., all of the letters of the alphabet, the numerals 0–9, a period (.), a comma (,) etc. The type bars extend beyond the outer periphery of the typehead latch disc 131. More specifically, the type bars extend radially outwardly to a point where the tip of a type bar will overlie the outer upper peripheral edge of a token located at the engraving station, beneath the type head 113, when appropriately positioned. Formed in or attached to the lower surface of the outer tips of the type bars 135 are raised type. As a result, when the press head 113 is moved downwardly (when the press motor 103 is activated, as previously described), the type of the type bar aligned beneath the press head is pressed into the top peripheral edge of the token, whereby a character is created therein.

Affixed to the typehead shaft 125, above the type bars 135, is a cylindrical, protection disc 139. The protection disc 139 is attached to the typehead latch disc by a pair of bolts 141. The outer peripheral edge of the protection disc is scalloped, i.e., it is formed by a plurality of adjacent circular curved regions. The number of scallops is equal to the number of type bars. The protection disc is sized and positioned such that a type arm extends outwardly intermediate the peripheral projections defining each scallop.

The diameter of the protection disc and the size of the scallops are such that a scallop lying above a particular type arm just fits about the lower end of the press head 113, when the press head is reciprocated downwardly. Since the lower end of the press head is in the form of an inverted truncated cone, the press head tends to align a scallop and, thus, its related type head if they are slightly misaligned when the press head is moved downwardly during engraving. On the other hand, the "teeth" between scallops prevent downward typehead movement when a severe misalignment problem is present. In this manner the type bars are protected under severe misalignment conditions.

Mounted on the typehead shaft 125, above the outwardly extending portion of the top wall 79 of the housing 73, is a click disc 143. The click disc 143 also includes a scalloped outer peripheral edge. Again, the scallops are equal in number to the number of type arms 135. The scallops coact with a spring loaded ball detent mechanism 145 affixed to the upper surface of the outwardly extending portion of the upper wall 79 of the housing 73, such that a "click" occurs each time the typehead shaft is moved one character position. The upper end of the typehead shaft 125 passes through an indicator 147. The indicator 147 may take the form of a disc, as illustrated, or it may be formed by an upper wall or cover of a housing within which the mechanism of the invention is mounted. The indicator 147 includes a plurality of character symbols 149 imprinted on or formed in its upper surface along a circular path. The character symbols are equal in number and related to the type located on the outer tips of the type bars.

Affixed to the upper tip of the typehead shaft 125 is an indicator arrow 151. The indicator arrow 151 is positioned such that when it points to a particular character symbol 149, the type bar with similar type on its lower surface is in an engraving position above the upper, outer peripheral edge of a token located at the engraving station. As a result, if the type motor is thereafter energized, the particular character being pointed to is engraved in the upper, outer peripheral edge of the token.

The typehead assembly 19 also includes a mechanism for locking the type head in place during engraving. The print head locking mechanism includes a slide 153 having a triangular shaped end. This arrow shaped slide 153 is mounted in an undercut slot 155 formed in the upper surface of the support plate 111. The slot 155 is radially aligned with respect to the large circular aperture 129 formed in the support plate 111, and, the triangular shaped end of the slide points toward the large circular aperture. Thus, the triangular shaped end of the slide 153 is aligned with the triangularly shaped teeth in the outer periphery of the typehead latch disc 131. It is pointed out here that the number of triangular "teeth" in the outer periphery of the latch disc 131 is equal to the number of type bars; and, that these teeth are positioned such that a related type bar is in an engraving position above a token at the engraving station when a related triangular tooth is aligned with the triangular end of the slide 153.

The other end of the slide 153 rides against one end of a spring 161 that presses against the mid-portion of a lever arm 157. A plate 159 affixed to the top of the support plate 11 so as to overlie a portion of the slot 155 prevents the slide from rising out of the slot 155.

The lever arm 157 is generally vertical and passes through an aperture 156 that intersects the outer end of the undercut slot 155. The upper end of the lever arm 157 is rotatably connected to the upper end of an upwardly extending bracket 163 located adjacent to the aperture 156. The axis of rotation is horizontal. The bracket 163 is affixed to the upper surface of the support port plate 111. The lower end of the lever arm 157 is connected by a spring chain assembly 165 to the movable element of a solenoid 167. A semi-resilient bumper 169 spans the aperture 156 on the side of the lever arm 157 remote from the side impinging on the coil spring 161. Located beneath the plate 159 alongside the undercut slot 155 is a contiguous undercut region 170. A pin 171 (FIG. 3) affixed to the arrow shaped slide projects into the undercut region 170. Located between the pin 171 and the wall of the undercut region 170 opposite to the lever arm 157 is a coil spring 172. This pin/coil spring arrangement creates a return force that moves the arrow shaped slide out of contact with the typehead latch disc 131 in the absence of lever arm pressure.

In operation, when the solenoid 167 is energized, it pulls the lever arm 157 toward the typehead latch disc 131, whereby the triangular shaped end of the slide 153 is moved into one of the triangular shaped apertures formed in the outer periphery of the typehead latch disc. This action partially compresses the coil spring 161 located between the slide and the lever arm. As a result, the typehead latch disc and, thus, the typehead is latched, whereby the application of force to the indicator arrow is prevented from rotating the typehead. Subsequent to locking the type head in place, in timed sequence, as hereinafter described, the press motor 103 is activated and a character is engraved into the upper surface of the token. After engraving is complete, the solenoid 167 is deenergized and the coil spring 171 located in the adjacent undercut region 170 (which is compressed during latching) moves the slide and the lever arm 157 away from the typehead latch disc 131, whereby the typehead is free to rotate as an operator moves the indicator arrow 151 to the next character position.

Token Indexing Assembly

The token indexing assembly 20 is best seen in FIG. 4 and includes an anvil 173 mounted in an anvil support 175 located beneath the token engraving station. The anvil 173 includes a cylindrical, disc-shaped upper section and a downwardly projecting, axially aligned, cylindrical projection 177. The cylindrical projection lies in a mating cylindrical aperture formed in the upper end of the anvil support 175. A retaining pin 179 threaded inwardly through the anvil support 175, projects into an undercut ring formed in the cylindrical projection 177 of the anvil 173.

The anvil support 175 is also generally cylindrical. The lower region or leg of the anvil support is smaller in diameter than the upper or anvil supporting region and is mounted in bearings 182. The bearings are mounted in an anvil support housing 181 attached to the lower surface of the support plate 11. Affixed to the lower end of the anvil support 175, beyond the lower end of the anvil support housing 181 is a keeper disc 183. The outer periphery of the keeper disc 183 is scalloped and the scallops coact with a keeper 185 mounted in the anvil support housing 181. The keeper includes a vertical shaft, preferably formed of spring steel, having a roller 187 affixed to its lower end. The roller is aligned and coacts with the scallops formed in the keeper disc 183.

Affixed to the anvil support, beneath the keeper disc 183, is a ratchet disc 189. The ratchet disc coacts with a ratchet arm 191 mounted on a bracket 193 rotatably affixed to the anvil support, beneath the ratchet disc 189. More specifically, the bracket 193 is mounted on the anvil support 175 beneath the ratchet disc 189 so as to be rotatably movable with respect to the ratchet disc 189, about a vertical axis. The ratchet arm 191, which is preferably formed of spring steel has one end affixed to the bracket 193, by a pin, for example. The other end of the ratchet arm interacts with teeth of the ratchet disc 189 in a manner such that when the bracket 193 is rotated in one direction, in the manner hereinafter described, the ratchet arm causes the ratchet disc 189 and, thus, the anvil 173 to rotate. Rotation of the bracket 193 in the opposite direction is prevented from causing reverse rotation of the ratchet disc 189 and the anvil 173 by the keeper 185. In a conventional manner, during reverse movement, the ratchet arm is sprung outwardly.

The outer end of the bracket 193 is connected by a connecting rod 195 to the lower end of the lever arm 157 that operates the arrow-shaped slide 153. As a result, each time the solenoid 167 is activated, and the slide 153 is moved to engage the typehead latch disc 189 131, the ratchet disc is indexed. In this manner, the anvil 173 and the token supported thereon are indexed. The degree of index movement, of course, is one character position.

It will be appreciated from the foregoing description that the invention provides both an uncomplicated mechanism for moving tokens through a token engraving apparatus and an uncomplicated engraving mechanism. Even though these mechanisms are uncomplicated, they operate in a manner that produces clear, accurately positioned characters in the upper outer peripheral surface of blank tokens. The latter benefits are achieved as a result of locking the typehead in place (by the arrow shaped slide) during the engraving operation and as a result of locking the slide in place (by the detent mechanism), also during the engraving operation. Potentially destructive operation that might take place as a result of severe print head misalignment is prevented by the protection disc.

ELECTRONIC SUBSYSTEM

The foregoing description has described a preferred embodiment of a mechanical mechanism formed in accordance with the invention. The following description describes an electronic subsystem, also formed in accordance with the invention, for controlling the mechanical mechanism. The electronic subsystem is illustrated in FIG. 6 and includes: a power on reset circuit 199; credit logic 201; engrave logic 203; a counter and display 205; maximum character logic 207; eject logic 209; slide logic 211; hold down logic 213; a blank token sensor inverter 214; out-of-service logic 215; and, chain logic 217.

Prior to describing the foregoing circuits in detail and their methods of operation, certain items are first pointed out, since an understanding of these items will assist in the understanding of the operation of the electronic subsystem. First, the invention is normally used in a coin operated machine. As a result, the electronic subsystem disables the machine until a predetermined amount of money, usually in the form of coins, is inserted into the machine. The insertion of coins is sensed by a credit switch, designated S1. Once the machine is enabled, the operator or customer manually rotates the indicator arrow until it points toward the first character to be engraved. Thereafter, the customer or operator actuates an engrave switch, designated S2, whereby the press motor is energized and a character is engraved in the manner previously described. The customer then points the indicator arrow toward the next character to be engraved and then actuates the engrave switch again. This cycle is repeated until all of the desired characters are engraved (or a maximum number have been engraved). After the last character is engraved (assuming that this condition is reached before the maximum number is reached), the customer or operator actuates an eject switch, designated S3. Actuation of the eject switch energizes the slide motor 25, whereby the token is moved to the ejection station. After ejection, the slide moves to the token supply station where it receives a blank token. The slide, continues to move until the new blank token is moved to the engraving station, in the manner previously described. The actuation of the eject switch, S3, also causes a chain to be ejected. More specifically, actuation of S3 also energizes a motor that drives a chain dispenser. (A suitable chain dispenser is described in U.S. Pat. No. 4,009,627 entitled "Method and Device for Dispensing Portions of a Chain" issued Mar. 1, 1977.) The ejected chain and an engraved token having a suitable aperture are adapted to form a keychain. Should the mechanical mechanism become jammed or run out of blank tokens, an out-of-service display is lit.

The home or park position of all of the motor operated mechanical subsystems, e.g., press, slide and chain dispenser, are sensed by suitable position sensing devices, such as hall effect devices. In this regard, PS1 designates the output of a sensor that senses the home position of the press assembly; PS2 designates the output of a sensor that senses the home position of the slide; and, PS3 designates the output of a sensor that senses the home position of the chain dispenser. In operation, when one of the motors is energized, it starts from its home position, goes through a single cycle of operation and stops when it returns to its home position. In addition, a sensor senses when the machine is out of blank tokens. PS4 designates the output of the blank token sensor. This sensor may be a pressure sensitive switch that is normally open, whereby PS4 is high when tokens are present and low when tokens are absent.

Turning now to a more complete description of the electronic control system illustrated in FIG. 6, the power on reset circuit 199 comprises: a capacitor designated C1; a resistor designated R1; and, an inverter designated I1. C1 and R1 are connected in series, in that order, between a DC voltage source designated +V and ground. The junction between C1 and R1 is connected to the input of I1. The output of I1 is a reset signal designated R. The power on reset circuit senses when power is applied to the electronic subsystem of the invention. When power is applied, the input of I1 starts high (e.g., at +V) and goes low (e.g., to ground) at a rate determined by the time constant of C1/R1. Since the input of I1 goes from high to low, the output of I1, denoted R, goes from low to high. The initial low resets various portions of the logic circuits hereinafter described. The following high enables gates that allow reset actions to occur during the operative sequences of the invention hereinafter described.

Credit logic 201 comprises: a two-input AND gate designed G1; two two-input NAND gates designated G3 and G4; an inverter designed 12; a resistor designated R2; and an engrave indicator 221. The credit switch, S1, which is a momentary contact switch, is connected between ground and one input of G3. The same input of G3 is connected through R2 to +V. The output of G3 is connected through I2 to the input of the engrave indicator 221 and to one input of G4. The output of G4 is connected to the second input of G3. The output of the power on reset circuit, R, is connected to one input of G1. The second input of G1 is obtained from the chain logic in the manner hereinafter described. The output of G1 is connected to the second input of G4.

It will be appreciated from the foregoing description that G3/G4 form a NAND gate latch. The set or Q output of this latch is the output of G3 and the reset or Q output is the output of G4. The G3/G4 latch is reset when power is first applied and, thereafter, when the chain logic input to G1 goes low. The G3/G4 latch is set when S1 is closed (due to the insertion of coins into the machine), since the closure of S1 causes a high/low transition on the related input of G3. When the G3/G4 latch is set, the engrave indicator 221 is activated. Activation of the engrave indicator causes a light to be lit indicating to the customer that the machine is enabled to engrave characters.

Engrave logic 203 comprises: two two-input OR gates designated G5 and G6; four two-input AND gates designated G7, G8, G9 and G10; two two-input NAND gates designated G11 and G12; two inverters designated I3 and I4; five resistors designated R3, R4, R5, R6 and R7; and, three capacitors designated C2, C3 and C4. R3, R5 and C3 are connected in series, in that order, between +V and ground. The junction between R3 and R5 is connected through the engrave switch, S2, to ground. The same junction is connected to one side of C2. The other side of C2 is connected through R4 to +V; and, to one input of G5. The Q output of the G3/G4 latch of the credit logic 201 is connected to the second input of G5. The output of G5 is connected to one input of G6. The second input of G6 is connected to the set (Q) output of a latch forming a portion of the slide logic hereinafter described.

The output of G6 is connected to one input of G7. PSI, which is the signal produced by the position sensor that senses the home or park position of the press, is applied through I3 to the second input of G7. PS1 is also applied through C4 to one input of G8. R6 and R7 are connected between +V and the opposite ends of C4. The second input of G8 is connected to receive the R output of the power on reset circuit 199, previously described.

The output of G7 is connected to one input of G11 and the output of G8 is connected to one input of G12. The outputs of G11 and G12 are cross coupled, whereby G11 and G12 form a NAND gate latch. The set or Q output of the G11/G12 latch is the output of G11 and the reset of Q output is the output of G12. The output of G11 is also connected to one input of G9. The second input of G9 is connected to the reset (Q) output of a slide logic latch hereinafter described. The output of G9 is connected to one input of G10. The second input of G10 is connected to the out-of-service logic 215 in the manner hereinafter described. This particular input goes low when the out-of-service logic determines that, for one reason or another, the machine is to be shut down. The output of G10 is connected to the input of I4 and the output of I4 is a signal adapted to control the application of power to the press motor 103, as signified by the TO PRESS MOTOR designation. This signal also controls the energization of the solenoid 167 that locks the typehead in place during engraving.

In operation, when the credit logic latch (G3/G4) is set as a result of S1 being closed due to the receipt of a coin or coins, its Q output goes low. This low output enables G5. Thereafter, each time the operator or customer actuates the engrave switch, S2, an engrave pulse occurs on the output of G5. (The R3, R4, C2, R5 and C3 network prevents contact bounce from causing more than one pulse on the related input of G5.) As will be better understood from the following description, when the slide is in its park position, the set (Q) output of the slide logic latch is low, whereby G6 is enabled. As a result, each engrave pulse passes through G6 and is applied to the related input of G7. When the press is in its park position, PS1 is low, whereby the output of I3 is high. Consequently, assuming the press is in its park position when an engrave pulse occurs, the engrave pulse passes through G7 and sets the engrave logic latch formed by G11/G12. As a result, the Q output of this latch goes high. This high passes through G9 and G10 and triggers the press motor power circuit. The signal passes through G9 because the slide logic latch is normally reset when an engrave pulse occurs, whereby the Q output it applies to G9 is high. G10 is enabled as long as the out-of-service logic circuit does not detect a condition requiring machine shut down, such as a jam in the mechanical mechanism. If either of the opposite conditions exist (i.e., the slide logic latch is set or the out-of-service logic detects a condition requiring machine shut down), setting the G11/G12 latch does not trigger the press motor.

As soon as the press motor is energized and its shaft starts to move, PS1 goes high, whereby G7 is immediately disabled. As a result any further actuation of the engrave switch by a customer or operator is ignored. The shifting of PS1 from low to high causes C4 to charge; however, this charge does not reset the G11/G12 latch, since a NAND gate latch is set and reset when its related input goes from a high to low, not low to high. Charging of C4, of course, causes the output of G8 to go from low to high. When the press completes its cycle of operation, and returns to its home or park position, PS1 goes from high to low. This shift discharges C4, whereby the output of G8 goes low and the G11/G12 latch is reset. Thereafter, the operator or customer moves the typehead to the next desired character position, actuates the engrave switch, and the cycle is repeated. During the period of time the press motor is operating the typehead lock solenoid 167 is also energized. As previously discussed this solenoid prevents the manual rotation of the typehead during engraving. In addition, it causes the token to be indexed just prior to engraving.

The counter and display 205 comprises: a one's binary coded decimal (BCD) counter 223; a ten's BCD counter 225; a one's decoder 227; a ten's decoder 229; a one's display 231; a ten's display 233; and, a two-input NAND gate designated G13. The set output of the engrave logic latch, i.e., the Q output of the G11/G12 latch, is connected to the count input of the one's BCD counter 223. The overflow output of the one's BCD counter is connected to the count input of the ten's BCD counter 225. Hence, the next pulse after the one's BCD counter counts up to 9 causes the ten's BCD counter to increment by one. The binary outputs of the one's BCD counter and the binary outputs of the ten's BCD counter are connected to the inputs of the one's decoder 227 and the ten's decoder 229, respectively. The output(s) of the one's decoder is connected to the one's display 231 and the output(s) of the ten's decoder 229 is connected to the ten's display 233. One input of G13 is connected to the R output of the power on reset circuit 199. The second input of G13 is connected to the reset (Q) output of the slide logic latch hereinafter described. The output of G13 is connected to the reset input of the ten's BCD counter 225, which, in turn, is connected to the reset input of the one's BCD counter 223. While the one's and ten's BCD counters may take on various forms, they each may be formed by one-half of a 4518B Dual BCD up counter, for example. Such counters are reset when their reset inputs go high.

The operation of the counter and display 205 is relatively conventional. Each time the engrave logic latch G11/G12 is set, the one's BCD counter is incremented by one decimal value. The binary output of the one's BCD counter reflects the count value in binary coded decimal form. When the one's BCD counter reaches a 9 count, the next setting of the engrave logic latch causes the ten's BCD counter to increment by one; and the one's BCD counter to cycle to zero. The BCD outputs of the one's and ten's BCD counters are decoded by the one's and ten's decoders, respectively. These decoders, in turn, cause the appropriate one's or ten's display, which may be seven segments displays, for example, to display appropriate decimal characters. The one's and ten's BCD counters are reset when the output of G13 goes high. Such a high occurs when power is first applied and when the slide logic latch is set in the manner hereinafter described.

The maximum character logic 207 comprises: two two-input AND gates designated G14 and G15; and, a two-input NAND gate designated G16. The maximum character logic forms a decoder connected to selected outputs of the one's and ten's BCD counters. When the count outputs of these counters reaches a predetermined level, determined by the selected outputs, the output of the maximum character logic shifts from high to low. In this regard, the inputs of G14 are connected to the LSB (least significant bit) and to the LSB +1 outputs of the ten's BCD counter 225. These outputs are high when the ten's BCD count is binary the equivalent of the decimal number three (3). Thus, the output of G14 shifts from low to high when the binary output of the ten's BCD counter is equal to the decimal number 3, which indicates that at least 30 engrave pulses have been counted. The inputs of G15 are connected to the LSB +1 and the LSB +2 outputs of the one's BCD counter. These outputs are both high when the one's BCD count is the binary equivalent of the number six (6). Hence, the output of G15 shifts from low to high each time the one's BCD counter counts up to the decimal number 6. Thus, this high occurs when 6, 16, 26 or 36 engrave pulses have been counted. The outputs of G14 and G15 are each connected to one input of G16. Since the only time both the G14 and G15 outputs are high is when 36 pulses have been counted, the output of G16 shifts from high to low when the one's and ten's BCD counter have counted 36 engrave pulses. Hence, the maximum character logic produces an output shift only after 36 characters have been engraved. Obviously, 36 is merely exemplary and any other desired number can be utilized, as desired. Of course, should a different number be chosen, the decoder (formed by the maximum character logic) may have to take a substantially different form, which will be readily apparent to those skilled in the digital logic art.

The eject logic 209 comprises: a resistor designated R8; two inverters designated I5 and I6; two two-input OR gates designated G17 and G18; three two-input AND gates designated G19, G20 and G21; two two-input NAND gates designated G22 and G23; and, an eject indicator 235.

One input of G17 is connected through the eject switch S3 to ground. The same input of G17 is connected through R8 to +V. The least significant bit (LSB) output of the one's BCD counter 223 is connected through 15 to one input of G22. The set (Q) output of the G3/G4 latch of the credit logic 201 is connected to one input of G19. The reset (Q) output of the slide logic latch hereinafter described is connected to the second input of G19. The output of G19 is connected to one input of G23. The outputs of G22 and G23 are cross coupled, whereby G22 and G23 form a NAND gate eject logic latch. The set (Q) output of the set logic latch, is the output of G22 and is connected through I6 to the input of the eject indicator 235. The reset (Q) output of the G22/G23 latch is output of G23 and is connected to one input of G18. The second input of G18 is connected to the S1 input of the credit logic latch G3/G4. The output of G18 is connected to one input of G21 and the output of G17 is connected to one input of G20. The output of G20 is connected to the second input of G21. The second input of G20 is connected to the output of G16 of the maximum character logic 207.

Normally, when the customer or operator of the machine has caused the desired number of characters to be engraved, he actuates the eject switch S3 and causes the eject logic to activate the slide logic 211 move the token to the ejection station. Alternatively, when 36 characters have been engraved, the eject log automatically activates the slide logic. In addition, the chain logic is activated, causing a chain to be dispensed.

Turning now to a more detailed description of the operation of the eject logic 209; when the credit switch S1 is actuated, a pulse will occur on the output of G18 only if G18 is enabled. Normally, this pulse will not occur because the G22/G23 latch will be be reset upon the completion of the last slide cycle. If G18 is enabled, because the G22/G23 latch if set (i.e., its Q output is high and its Q output is low) this pulse will occur. If the pulse occurs, the slide will cycle in the manner hereinafter described and cause the G22/G23 latch to be reset. As a result, initially, the G22/G23 latch is reset, whereby the eject indicator is unlit.

As soon as the customer or operator causes the first character to be engraved, the LSB output of the one's BCD counter 223 goes high, causing a high-low shift on the output of I5. As a result, the G22/G23 latch is set and the eject indicator 235 is lit. The G22/G23 latch remains set until reset by the slide cycling in the manner herein described.

Prior to the eject logic latch being set G17 was disabled. As a result any operation of the eject switch S3 was ignored, consequencly, a customer could not cause an ejection. This situation changes after the first character is engraved since the eject logic latch (G22/G23) is then set. The customer is advised of this fact by the eject indicator being lit, as previously described.

When the customer or operator has engraved a total number of desired characters, as noted above, he actuates S3. Since G17 is now enabled, the pulse caused by the closure of S3 is applied to G20. This pulse creates a pulse on the output of G20. Since G20 is enabled as a result of the output of G16 being high. This pulse activates the chain logic 217 in the manner hereinafter described, causing a chain to be dispensed. The pulse to the output of G20 also causes a pulse to occur on the output of G21, since the output of G18 is high, as a result of its credit logic input being high. This pulse activates the slide logic 211, whereby an engraved token is moved to the ejection station and a blank token is picked up and moved to the engraving station.

In a similar manner, the token is ejected and a chain dispensed, both automatically, when the maximum number of characters has been engraved. In this situation, the output of G16 shifts low as previously described. This shift passes through G20, since G20 is enabled by the high output of G17 caused by the high on its R8 input. The high-low shift in the output of G20 causes a similar shift in the output of G21, whereby both the slide logic and the chain logic are actuated.

The slide logic 211 comprises: two resistors designated R9 and R10; a capacitor designated C5; two inverters designated I7 and I8; four two-input AND gates designated G24–G27; two two-input NAND gates designated G28 and G29; and, a monostable multivibrator 237.

The output of G21 of the eject logic is connected to one input of G24. PS2 is applied through I7 to the second input of G24. PS2 is also applied through C5 to one input of G25. The opposing terminals of C5 are each connected through one of R9 and R10 to +V. The R output of the power on reset circuit 199 is applied to the second input of G25. The output of G24 is connected to one input of G28 and the output of G25 is connected to one input of G29. The outputs of G28 and G29 are cross coupled to the other inputs of the opposing gate. The output of G28, which is the set (Q) output of the G28/G29 (or slide logic) latch, is connected to one input of G26 and to one input of G6 of the engrave logic as previously discussed. The output of G29, which is the reset (Q) output of the G28/G29 latch, is connected to one input of G9 of the engrave logic, also as previously described. The output of G29 is also connected to the trigger input of the monostable multivibrator 237. The output of G12 of the engrave logic 203 is connected to the second input of G26 and the output of G26 is connected to one input of G27. The second input of G27 receives the output of the out-of-service logic 215, which, as hereinafter described, shifts from high to low when the out-of-service logic detects a failure in the mechanical mechanism, or that the machine has run out of blank tokens. The output of G27 is connected to the input of I8. The output of I8 is a control signal connected to control the application of power to the slide motor and is designated TO SLIDE MOTOR. The R output of the power on reset logic is connected to the reset input of the monostable multivibrator 237.

Since the operation of the slide logic will be more readily understood if it is considered in conjunction with the operation of the hold down logic, a description of the nature of the hold down logic is first described. The hold down logic comprises: a two-input OR gate designed G30; and, an inverter designated I9. One input of G30 is connected to the output of the monostable multivibrator. The second input of G30 is connected to the output of G27 of the slide logic. The output of G30 is connected to the input of I9 and the output of I9 is connected to control the hold down solenoid 101 (FIG. 4) previously described. This output is denoted TO HOLD DOWN SOLENOID in FIG. 6.

Turning now to a composite description of the operation of the slide logic and the hold down logic; when the output of G21 goes low either as a result of S3 being actuated (momentarily closed) or as a result of the output of G16 going low because the maximum number of characters that can be engraved have been engraved, the output of G24 goes low. (G24 is enabled because the slide is in its park position, whereby PS2 is low, forcing the output of I7 high.) When the output of G24 goes low, the slide logic latch, G28/G29, is set. When the slide logic latch is set, its Q output is high and its Q output is low. The low Q output disables AND gate G9 and the high Q output disables OR gate G6. As a result, any further actuation of the engrave switch, S2, is ignored. In addition, the low Q output of the slide logic latch resets the one's and ten's BCD counters via G13; and, resets the eject logic latch (G22/G23) via G19.

When the slide logic latch, G28/G29 is set, the output of G26 shifts high, assuming that the press is in its park position whereby the reset output (Q) of the engrave latch (G11/G12) is high. Alternatively, if the slide logic latch is set prior to the press returning to a park position, the output of G26 goes high when the G11/G12 latch of the engrave logic is reset at the end of the engrave cycle. Regardless of the sequence of operation, when the output of G26 goes high, the output of G27 goes high, unless the out-of-service logic is producing a low output, which denotes the detection of a machine fault, or a lack of blank tokens. The shift of the output of G27 from low to high causes two actions to occur. First, the output of G30 is forced high. This high output is inverted by I9 and used to control the energization of the hold down solenoid. More specifically, when the output of I9, denoted TO HOLD DOWN SOLENOID in FIG. 6, is high the hold down solenoid 101 (FIG. 4) is de-energized, whereby the vertical hold down shaft presses against the top of a token. When the output of I9 goes low, the hold down solenoid id energized and raises the vertical shaft. The hold down solenoid remains energized as long as the output of I9 is low.

The high output of G27 via I8 also causes the slide motor to be energized. As a result, the slide moves the engraved token to the ejection station and, then, picks up and moves a blank token to the engraving station all in the manner previously described. When the slide logic latch reaches its park position, PS2 goes low, whereby the charge on C5, developed during the period of time PS2 was low, via G25, resets the slide logic latch.

When the slide logic latch is reset its Q output goes high. This low-high shift triggers the monostable multivibrator 237, whereby its output shifts from low to high for its time-out period. During this period of time the output of G30 is maintained high, whereby the hold down solenoid remains energized. As a result, the vertical shaft 93 is prevented from dropping for a short period of time, e.g., one second, after the slide motor is de-energized. This period of time allows the slide to come to a complete stop prior to the vertical shaft being allowed to drop.

It will be appreciated at this point that a control system for controlling the entire operation of the mechanical mechanism illustrated in FIGS. 1-5 has been described. The remaining logic circuits illustrated in FIG. 6 are directed to two additional features. Specifically, the out-of-service logic is adapted to shut down the operation of the electronic control and, thus, the mechanical mechanism if the mechanical mechanism becomes jammed, or if the machine runs out of blank tokens. The chain logic is adapted to control a chain dispenser as briefly described above.

The blank token sensor inverter 214 comprises a single inverter designated I9A. PS4, the output of the sensor adapted to sense the presence or absence of blank tokens at the token receiving station, is connected to the input of I9A. When blank tokens remain in the machine PS4 is high. In the absence of blank tokens PS4 goes low. Thus, the output of I9A goes from low to high when the machine runs out of blank tokens.

The out-of-service logic 215 illustrated in FIG. 6 comprises: three two-input OR gates designated G31, G31A and G32; two two-input AND gates designated G33 and G34; an inverter designated I10; and a monostable multivibrator 239. The set (Q) output of the engrave logic latch (G11/G12) is connected to one of G31. The second input of G31 is connected to the set (Q) output of a latch forming a part of the chain logic hereinafter described. The output of G31 is connected to one input of G31A. The output of I9A is connected to the second input of G31A and the output of G31A is connected to one input of G32. The set (Q) output of the slide logic latch (G28/G29) is connected to the second input of G32. The output of G32 is connected to: the trigger input of the monostables multivibrator; one input of G33; and, one input of G34. The second input of G33 is connected to the R output of the power on reset circuit 199. The output of G33 is connected to the reset input of the monostable multivibrator 239. The output of the monostable multivibrator is connected to the second input of G34. The output of G34 is connected to the input of I10. The output of I10 is connected to the second input of G10 of the engrave logic 203 and to the second input of G27 of the slide logic, as previously described. The output of I10 is also connected to control an out-of-service indicator, as denoted by the OUT OF SERVICE designation in FIG. 6.

In essence, the out-of-service logic is a timer that starts when a related latch is set, or when the output of I9A goes high to denote the absence of blank tokens. If the function started when the latch is set does not terminate and reset the latch before a predetermined time period, an out-of-service light is lit and the energy applied to the slide and press motors is terminated as a result of their related control signals going high. For example, when the engrave logic latch, G11/G12 is set, the output of G31 goes high. This high causes the output of G32 to go high and trigger the monostable multivibrator 239. In this case, the output of the monostable multivibrator drops low when triggered and remains low for its time-out period. When the monostable multivibrator times out, its output goes high. If the G11/G12 latch has not been reset prior to this time period elapsing, the inputs to G34 are both high. As a result, the output of G34 goes high whereby the output of I10 goes low. When the output of I10 goes low, G10 and G27 are disabled whereby the engraving motor and the slide motor are de-energized. (As will be better understood from the following description, the chain logic is disabled in a similar manner.) At the same time, the out-of-service indicator is lit. At the same time the output of I10 goes low, the output of a further inverter, connected to the output of I10 and designated I10A goes high. The output of I10A is designated COIN RETURN RELAY. This output controls a holding relay in the coin box. When the out-of-service indicator is lit, the COIN RETURN RELAY de-energizes the holding relay, whereby any coins thereafter inserted into the machine are returned.

If the G11/G12 latch resets prior to the monostable multivibrator timing out, which is the normal situation and means that the press has completed a cycle within the time out period, the output of G32 goes low before the end of the time-out period. The shifting of the output of G32 from high to low resets the monostable multivibrator via G33. As long as the output of G32 remains low, the output of G33 remains low, whereby the monostable multivibrator is held in a reset state. The setting and resetting of the slide logic latch, G28/G29, and the chain logic latch causes the identical operation of the out-of-service logic. As a result, if either the slide or chain dispenser mechanism do not complete a cycle of operation prior to the end of the time-out period the machine is shut down.

The chain logic 217 comprises: two resistors designated R11 and R12; a capacitor designated C6; two inverters designated I11 and I12; three two-input AND gates designated G35, G36 and G37; and, two two-input NAND gates designated G38 and G39. The output of G20 of the eject logic is connected to one input of G35. PS3, which denotes whether or not the chain dispenser is in its park position, is applied through I11 to the second input of G35. (PS3 is low when the chain dispenser is in a park position and high when it is in a non-park position.) PS3 is also applied through C6 to one input of G36. The opposite sides of C6 are connected through R11 and R12, respectively, to +V. The R output of the power on reset circuit 199 is connected to the second input of G36. The output of G35 is connected to one input of G38 and the output of G36 is connected to one input of G39. The outputs of G38 and G39 are cross-coupled to their other inputs. Thus, G38 and G39 form the chain logic latch previously referred to. The output of G38, which is the set (Q) output of the chain logic latch, is connected to the second input of G31 of the out-of-service logic 215, previously described, and to one input of G37. The second input of G37 is connected to the output of I10 of the out-of-service logic. The output of G37 is connected to the input of I12 and the output of I12 is a control signal, designated TO CHAIN MOTOR, that controls a motor adapted to operate the chain dispenser. The output of G39 is applied to the second input of G1 of the credit logic 201.

In operation, when the output of G20 shifts from high to low either because S3 is closed or the maximum number of characters engraved, the output of G35 shifts from high to low whereby the chain logic latch (G38/G39) is set. Setting this latch results in the output of G38 going high, whereby the monostable multivibrator 239 of the out-of-service logic starts timing out. At the same time, the output of G37 goes high and the output of I12 goes low. The low output of I12 causes the chain dispenser motor to start. The chain dispenser cycles through one cycle of operation, during which PS3 is high. This high causes C6 to charge. At the end of the sequence, when the chain motor reaches a park position, PS3 drops low, and the chain logic latch is reset, whereby the monostable multivibrator 239 is reset, unless the slide is still moving. In the latter case, the monostable multivibrator is reset when the slide reaches its park position. The output of G39, which is connected to G1, as previously indicated, is adapted to reset the credit logic (G3/G4) latch when the chain dispenser completes its sequence of operation, as a result of the Q output of the chain logic latch going from high to low at the end of this sequence.

It will be appreciated from the foregoing description that the invention not only includes a new and improved uncomplicated mechanical mechanism for use in token engraving, the invention also provides a reliable digital logic control system for controlling the operation of the mechanical mechanism. With respect to the control system, it should be recognized that the described logic circuits can be changed without departing from the spirit and scope of the invention. Thus, this aspect of the invention should not be construed as limited to the specific logic circuits described. Similarly, various changes can be made to the mechanical mechanism without departing from the spirit and scope of the invention. Hence, the invention can be practiced otherwise than as specifically described herein.

The embodiments of the invention in which an exclusive property or privilege is claimed are defined as follows:

1. An electronically controlled token engraving apparatus comprising:

(A) a mechanical mechanism for engraving tokens, said mechanical mechanism including:

(1) token movement means for moving a token along a path of travel between a token receiving station, a token engraving station and a token ejection station;

(2) token supply means located at said token supply station for supplying blank tokens to said token movement means;

(3) token engraving means located at said engraving station for engraving characters at predetermined positions in a token located at said token engraving station said token engraving means comprising:

(a) a typehead including a plurality of radial type bars, a character type being located on the lower peripheral surface of each type bar, said typehead mounted such that a selected type bar can be positioned above the upper peripheral surface of a token located at said token engraving station; and, (b) a press located above a radial type bar when said radial type bar is positioned above a token located at said token engraving station such that actuation of said press moves the outer periphery of said so located type bar downwardly into engraving contact with the upper peripheral surface of said token whereby a character is engraved into the upper peripheral surface of said token, said press including a vertically movable presshead and wherein said typehead includes a protection disk affixed to said type bars, above said type bars, said protection disk including a scalloped outer periphery, said scallops being equal in number to the number of type bars, said protection disk being mounted such that a type bar is centrally located in each scallop, said scallops being formed such that said presshead can pass through a scallop and impinge on a related type bar when said typehead is appropriately positioned; and, (4) token ejection means located at said token ejection station for controlling the ejection of tokens from said electronically controlled token engraving apparatus; and (B) an electronic subsystem for controlling said mechanical mechanism, said electronic subsystem comprising:

(1) token control means, connected to said token movement means and to said token ejection means, for controlling said token movement means such that said token movement means moves tokens between said token receiving station, said token engraving station and said token ejection station in a predetermined manner and for controlling said token ejection means such that engraved tokens are ejected from said electronically controlled token engraving apparatus subsequent to said tokens being engraved by said engraving means; and (2) token engraving control means connected to said token engraving means for controlling said token engraving means such that said token engraving means engraves characters at predetermined positions in said token.

2. An electronically controlled token engraving apparatus as claimed in claim 1 wherein:

(A) said path of travel of said token movement means between said token receiving station, said token engraving station and said token ejection station is linear; and, (B) said token movement means includes:

(1) a single aperture slide;

(2) a slide motor; and (3) coupling means for coupling said slide motor to said single aperture slide such that said single aperture slide is reciprocated once from said token engraving station, past said token ejection station to said token supply station and then back to said token engraving station for each revolution of the shaft of said slide motor.

3. An electronically controlled token engraving apparatus as claimed in claim 2 wherein said token movement means also includes a detent mechanism for latching said slide in a first position when said slide is at said token supply station and in a second position when said slide is at said token engraving station.

4. An electronically controlled token engraving apparatus as claimed in claim 3 including a support plate mounted in a horizontal plane, said single aperture slide mounted on said support plate for movement along said path of travel in a horizontal plane.

5. An electronically controlled token engraving apparatus as claimed in claim 4 including a typehead locking mechanism for locking said typehead in place when said press is actuated.

6. An electronically controlled token engraving apparatus as claimed in claim 5 wherein said typehead locking mechanism comprises:

a typehead latch disk affixed to said plurality of radial type arms, adjacent the lower surface thereof, the outer periphery of said typehead latch disk including a plurality of indentations, one indentation being related to each of said radial type bars; and latching means including a slide positioned so as to be movable into and out of said indentations, said latching means coupled to said token engraving control means such that said slide is moved toward said indentations when said press is actuated to engrave a character into the upper peripheral surface of a token.

7. An electronically controlled token engraving apparatus as claimed in claim 6 wherein said press is a toggle press that includes:

a pair of connected links movable between an aligned position and a toggle position, said pair of links being generally vertically arrayed, said presshead being affixed to the lower end of the lower one of said links, said pair of links and said presshead being mounted such that said presshead is raised and lowered, said presshead being lowered when said links are in said aligned position and raised when said links are in said toggle position; and, a press motor connected to said links so as to move said links from said toggle position, to said aligned position and back to said toggle position once for each revolution of the shaft of said press motor.

8. An electronically controlled token engraving apparatus as claimed in claim 7 wherein said token supply means includes an apertured plate located above said slide and a plurality of parallel vertical shafts mounted about said aperture in said apertured plate, said shafts positioned so as to hold a stack of tokens in a vertical pile above said aperture in said apertured plate.

9. An electronically controlled token engraving apparatus as claimed in claim 7 including an anvil located below a token located at said token engraving station for supporting said token; and, a hold down means positioned above said anvil and mounted so as to press said token against said anvil when a token is located at said token engraving station, said hold down means being raisable, said hold down means coupled to said token engraving control means such that said hold down means is raised when said single aperture slide is being moved.

10. An electronically controlled token engraving apparatus as claimed in claim 9 wherein said hold down means includes a solenoid and a vertically arrayed shaft, said vertically arrayed shaft being mounted for vertical movement above a token located at said token engraving station, said solenoid coupled to said vertically arrayed shaft such that the energization of said solenoid causes said vertically arrayed shaft to raise vertically away from a token located at said token engraving station.

11. An electronically controlled token engraving appartus as claimed in claim 10 including an indexing means coupled to said anvil, said indexing means adapted to index said anvil, and thus a token supported by said anvil, a character position each time said indexing means is actuated, said indexing means coupled to said slide of said typehead locking mechanism, such that said indexing means is actuated each time said slide of said typehead locking mechanism is moved toward said indentations in said typehead latch disk.

12. An electronically controlled token engraving apparatus as claimed in claim 11 wherein said token ejection means includes a closable aperture formed in said support plate beneath said slide, an arm for closing said aperture and movement means for moving said arm between a position whereat said aperture is closed by said arm and a position whereat said aperture is open, said movement means connected to said coupling means of said slide movement mechanism such that said aperture is open when said slide aperture is moved past said closable aperture as said slide is moved from said token engraving station to said token receiving station and closed when said slide aperture passes above said closable aperture as said slide aperture is moved from said token receiving station to said token engraving station.

13. An electronically controlled token engraving apparatus as claimed in claim 12 wherein said token engraving control means of said electronic subsystem includes:

an engrave switch;

engrave logic including a resettable engrave logic latch, said engrave logic latch connected to said engrave switch such that said engrave logic latch is set when said engrave switch is closed, said engrave logic latch connected to said press motor such that said press motor is energized when said resettable latch is set; and a position sensor for sensing when the shaft of said press motor is in a park position, said position sensor connected to said engrave logic latch so as to reset said engrave logic latch after said press motor is energized when said position sensor senses that the shaft of said press motor has returned to its park position after going through a single revolution.

14. An electronically controlled token engraving apparatus as claimed in claim 13 wherein said token control means of said electronic subsystem includes:

an eject switch;

eject logic connected to said eject switch to sense when said eject switch is closed;

slide logic connected to said eject logic, said slide logic including a resettable slide logic latch connected to said eject logic such that said slide logic latch is set when said eject logic detects the closure of said eject switch, said slide logic latch connected to said slide motor such that said slide motor is energized when said slide logic latch is set; and a position sensor for sensing when the shaft of said slide motor is in a park position, said position sensor connected to said slide logic latch so as to reset said slide logic latch after said slide motor is energized when said position sensor senses that the shaft of said slide motor has returned to its park position after going through a single revolution.

15. An electronically controlled token engraving apparatus as claimed in claim 14 including a counter and display connected to said engrave logic latch such that said counter and display counts up by one count each time said engrave logic latch is set and displays the total number of counts counted, said counter and display connected to said eject logic such that said eject logic is prevented from sensing the operation of said eject switch until said engrave logic latch is set once and one count is made by said counter and display.

16. An electronically controlled token engraving apparatus as claimed in claim 15 including maximum character logic connected to said counter and display for providing a signal when said counter and display counts a maximum number of pulses, said maximum character logic connected to said eject logic such that said signal causes said eject logic to set said slide logic latch when said maximum character logic detects the existence of said maximum number of counts counted by said counter and display in the same manner said slide logic latch is set when an eject switch closure is detected by said eject logic.

17. An electronically controlled token engraving apparatus as claimed in claim 16 including hold down logic connected to said slide logic and to said solenoid of said hold down means such that said solenoid is energized when said slide logic latch is set.

18. An electronically controlled token engraving apparatus as claimed in claim 18 wherein said slide logic includes a monostable multivibrator connected so as to be triggered when said slide latch is reset, the output of said monostable multivibrator connected to said hold down logic such that said hold down logic continues to energize said solenoid of said hold down means for a predetermined period of time after said slide logic latch is reset.

19. An electronically controlled token engraving apparatus as claimed in claim 18 including out-of-service logic connected to sense when said engrave logic and said slide logic latches are set and enable the application of said set signals to said press and slide motors, said enablement terminating if said engrave and slide logic latches are not reset within a predetermined period of time.

20. An electronically controlled token engraving apparatus as claimed in claim 19 wherein said out-of-service logic includes a monostable multivibrator, said monostable multivibrator being triggered when one or the other, or both, of said engrave logic and slide logic latches are set, the output of said monostable multivibrator connected so as to enable the set outputs of said engrave logic and slide logic latches to said press and slide motors, respectively.

21. An electronically controlled token engraving apparatus as claimed in claim 20, wherein said token engraving control means includes:

a credit switch; and, credit logic connected to said credit switch, said credit logic including a credit logic latch connected to said credit switch such that said credit logic latch is set when said credit switch is closed, said credit logic latch connected to said engrave logic so as to prevent said engrave logic latch from being set when said credit logic latch is in a reset state.

22. An electronically controlled token engraving apparatus as claimed in claim 1 including a support plate mounted in a horizontal plane, said token movement means mounted on said support plate for movement along said path of travel in a horizontal plane.

23. An electronically controlled token engraving apparatus as claimed in claim 22 wherein said engraving means comprises:

a typehead including a plurality of radial type bars, a character type being located on the lower peripheral surface of each type bar, said typehead mounted such that a selected type bar can be positioned above the upper peripheral surface of a token located at said token engraving station; and, a press located above a radial type bar when said radial type bar is positioned above a token located at said token engraving station such that actuation of said press moves the outer periphery of said so located type bar downwardly into engraving contact with the upper peripheral surface of said token whereby a character is engraved into the upper peripheral surface of said token.

24. An electronically controlled token engraving apparatus as claimed in claim 23 including a typehead locking mechanism for locking said typehead in place when said press is actuated.

25. An electronically controlled token engraving apparatus as claimed in claim 24 wherein said typehead locking mechanism comprises:

a typehead latch disk affixed to said plurality of radial type arms, adjacent the lower surface thereof, the outer periphery of said typehead latch disk including a plurality of indentations, one indentation being related to each of said radial type bars; and, latching means including a slide positioned so as to be movable into and out of said indentations, said latching means coupled to said token engraving control means such that said slide is moved toward said indentations when said press is actuated to engrave a character into the upper peripheral surface of a token.

26. An electronically controlled token engraving apparatus as claimed in claim 25 wherein said press is a toggle press that includes a pair of connected links movalbe between an aligned position and a toggle position, said pair of links being generally vertically arrayed, said presshead being affixed to the lower end of the lower one of said links, said pair of links and said presshead being mounted such that said presshead is raised and lowered, said presshead being lowered when said links are in said aligned position and raised when said links are in said toggle position; and, a press motor connected to said links so as to move said links from said toggle position, to said aligned position and back to said toggle position once for each revolution of the shaft of said press motor.

27. An electronically controlled token engraving apparatus as claimed in claim 1 wherein said token supply means includes an apertured plate located above said slide and a plurality of parallel vertical shafts mounted about said aperture in said apertured plate, said shafts positioned so as to hold a stack of tokens in a vertical pile above said aperture in said apertured plate.

28. An electronically controlled token engraving apparatus as claimed in claim 1 including an anvil located below a token located at said token engraving station for supporting said token; and, a hold down means positioned above said anvil and mounted so as to press said token against said anvil when a token is located at said token engraving station, said hold down means being raisable, said hold down means coupled to said token engraving control means such that said hold down means is raised when said token movement means is moving a token is being moved.

29. An electronically controlled token engraving apparatus as claimed in claim 28 wherein said hold down means includes a solenoid and a vertically arrayed shaft, said vertically arrayed shaft being mounted for vertical movement above a token located at said token engraving station, said solenoid coupled to said vertically arrayed shaft such that the energization of said solenoid causes said vertically arrayed shaft to raise vertically away from a token located at said token engraving station.

30. An electronically controlled token engraving apparatus as claimed in claim 29 including an indexing means coupled to said anvil, said indexing means adapted to index said anvil and, thus, a token supported by said anvil, a character position each time said indexing means is actuated.

31. An electronically controlled token engraving apparatus as claimed in claim 22 wherein said token ejection means includes a closable aperture formed in said support plate beneath said token movement means, an arm for closing said aperture and movement means for moving said arm between a position whereat said aperture is closed by said arm and a position whereat said aperture is open.

32. An electronically controlled token engraving apparatus comprising:

(A) a mechanical mechanism for engraving tokens, said mechanical mechanism including:

(1) token movement means for moving a token along a path of travel between a token receiving station, a token engraving station and a token ejection station;

(2) token supply means located at said token supply station for supplying blank tokens to said token movement means;

(3) token engraving means located at said engraving station for engraving characters at predetermined positions in a token located at said token engraving station; and, (4) token means located at said token ejection station for controlling the ejection of tokens from said electronically controlled token engraving apparatus; and, (B) an electronic subsystem for controlling said mechanical mechanism, said electronic subsystem comprising:

(1) token control means, connected to said token movement means and to said token ejection means, for controlling said token movement means such that said token movement means moves tokens between said token receiving station, said token engraving station and said token ejection station in a predetermined manner and for controlling said token ejection means such that engraved tokens are ejected from said electronically controlled token engraving apparatus subsequent to said tokens being engraved by said engraving means, said token control means of said electronic subsystem includes:

(a) an ejection switch;

(b) eject logic connected to said eject switch to sense when said eject switch is closed;

(c) movement logic connected to said eject logic, said movement logic including a resettable movement logic latch connected to said eject logic such that said movement logic latch is set when said eject logic detects the closure of said eject switch, said movement logic latch connected to said token movement means such that said token movement means is acutated when said movement logic latch is set; and, (d) a position sensor for sensing when said token movement means is in a park position, said position sensor connected to said movement logic latch so as to reset said movement logic latch, after said token movement means is actuated, when said position sensor senses that said token movement means has returned to its park position; and, (2) token engraving control means comprising:

(a) an engrave switch;

(b) engrave logic including a resettable engrave logic latch, said engrave logic latch connected to said engrave switch such that said engrave logic latch is set when said engrave switch is closed, said engrave logic latch connected to said token engraving means such that said token engraving means is actuated when said resettable latch is set; and, (c) a position sensor for sensing when said token engraving means is in a park position, said position sensor connected to said engrave logic latch so as to reset said engrave logic latch, after said token engraving means is actuated, when said position sensor senses that said token engraving means has returned to its park position.

33. An electronically controlled token engraving apparatus as claimed in claim 32 including a counter and display connected to said engrave logic latch such that said counter and display counts up by one count each time said engrave logic latch is set and displays the total number of counts counted, said counter and display connected to said eject logic such that said eject logic is prevented from sensing the operation of said eject switch until said engrave logic latch is set once and one count is made by said counter and display.

34. An electronically controlled token engraving apparatus as claimed in claim 33 including maximum character logic connected to said counter and display for providing a signal when said counter and display counts a maximum number of pulses, said maximum character logic connected to said eject logic such that said signal causes said eject logic to set said movement logic latch when said maximum character logic detects the existence of said maximum number of counts counted by said counter and display in the same manner said movement logic latch is set when an eject switch closure is detected by said eject logic.

35. An electronically controlled token engraving apparatus as claimed in claim 34 including out-of-service logic connected to sense when said engrave logic and said movement logic latches are set and enable the application of said set signals to said token engrave means and said token movement means, said enablement terminating if said engrave and slide logic latches are not reset within a predetermined period of time.

36. An electronically controlled token engraving apparatus as claimed in claim 35 wherein said out-of-service logic includes a monostable multivibrator, said monostable multivibrator being triggered when one or the other, or both, of said engrave logic and movement logic latches are set, the output of said monostable multivibrator connected so as to enable the set outputs of said engrave logic and movement logic latches to said token engrave means and said token movement means, respectively.

37. An electronically controlled token engraving apparatus as claimed in claim 36, wherein said token engraving control means includes:

a credit switch; and, credit logic connected to said credit switch, said credit logic including a credit logic latch connected to said credit switch such that said credit logic latch is set when said credit switch is closed, said credit logic latch connected to said engrave logic so as to prevent said engrave logic latch from being set when said credit logic latch is in a reset state.

38. An electronically controlled token engraving apparatus as claimed in claim 32, wherein said token engraving control means includes:

a credit switch; and, credit logic connected to said credit switch, said credit logic including a credit logic latch connected to said credit switch such that said credit logic latch is set when said credit switch is closed, said credit logic latch connected to said engrave logic so as to prevent said engrave logic latch from being set when said credit logic latch is in a reset state.

* * * * *